US006206727B1

(12) United States Patent
Aoyama et al.

(10) Patent No.: US 6,206,727 B1
(45) Date of Patent: Mar. 27, 2001

(54) TERMINAL AND CRIMPING METHOD

(75) Inventors: Masahiko Aoyama; Masashi Saito; Takashi Koide, all of Yokkaichi; Masahiro Tanaka, Aichi-ken, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/443,653

(22) Filed: Nov. 19, 1999

(30) Foreign Application Priority Data

Nov. 27, 1998 (JP) ..... 10-337723

(51) Int. Cl.[7] ..... H01R 9/05

(52) U.S. Cl. ..... 439/585; 439/610; 439/877; 439/424

(58) Field of Search ..... 439/585, 877, 439/610, 424, 423

(56) References Cited

U.S. PATENT DOCUMENTS

| | | | | |
|---|---|---|---|---|
| 1,556,465 | * | 12/1925 | Champion | 439/424 |
| 1,706,005 | * | 3/1929 | Thompson | 439/424 |
| 3,435,126 | * | 3/1969 | Hamilton | 439/424 |
| 3,728,665 | * | 4/1973 | Frey | 439/424 |
| 4,010,538 | * | 3/1977 | O'Keefe et al. | 439/585 |
| 5,169,340 | | 12/1992 | Nakata et al. | 439/607 |
| 5,658,163 | * | 8/1997 | DeRoss | 439/424 |
| 6,059,616 | * | 5/2000 | Bluemmel et al. | 439/877 |

FOREIGN PATENT DOCUMENTS

| | | |
|---|---|---|
| 4-52372 | 5/1972 | (JP) . |
| 5-27983 | 4/1993 | (JP) . |

* cited by examiner

*Primary Examiner*—Brian Sircus
*Assistant Examiner*—Hae Moon Hyeon
(74) *Attorney, Agent, or Firm*—Anthony J. Casella; Gerald E. Hespos; Michael J. Porco

(57) ABSTRACT

A terminal is provided for secure electrical connection to a shielded cable. The outer conductor 52 of the cable 50 is exposed and folded onto the sheath. A folded portion 55 is placed on a bottom portion 48 of the terminal while a bottom projection 61 at the bottom portion 48 of an outer terminal 40 bites into the folded portion. A crimping piece 46 of the outer terminal 40 is brought into close contact with the outer surface of the folded portion 55 and an upper projection 62 on the crimping piece 46 bites into a sheath 54 of the folded portion 55. A crimping piece 47 is brought into close contact with the outer surface of the folded portion 55 and the end thereof is placed on that of the crimping piece 46. The outer crimping portion 45 squeezes the sheath 54 and is crimped while being held in close contact with the sheath 54 beneath the folded portion 55, and the two projections 61, 62 bite into the sheath 54. Since the folded portion 55 and the outer crimping portion 45 are electrically connected to a sufficient degree and a sufficient fastening force can be obtained, a stable electrical connection can be established.

7 Claims, 5 Drawing Sheets

TERMINAL AND CRIMPING METHOD

BACKGROUND OF THE INVENTION

1. Field of the Invention

The present invention relates to a terminal and to a method for crimping a terminal on a shielded cable, and particularly relates to a terminal to be connected with a shielded cable by crimping.

2. Description of the Related Art

A prior art terminal for crimped connection to a shielded cable is disclosed in Japanese Unexamined Utility Model Publication No. 5-27983 and is identified by the numeral 1 in FIG. 11. The terminal 1 is provided with an inner conductor crimping portion 1*a,* an outer conductor crimping portion 1*b* and a sheath crimping portion 1*c* as shown in FIG. 11.

The prior art terminal 1 is obliged to have a long length in view of the three crimping portions 1*a,* 1*b* and 1*c* arranged along the terminal 1 for the connection with a shielded cable 2. This long length stands as a hindrance to making the entire terminal smaller.

The inventors herein have considered using one crimping portion which serves both as the outer conductor crimping portion 1*b* and as a sheath crimping portion 1*c*. In such a case, the outer conductor of the cable is folded back over the sheath of the cable and crimping is applied to this folded portion in a manner that is designed not to damage the outer conductor. Alternatively, or additionally, it is desirable to apply a so-called "overlap crimping" to deal with a variation in cable diameter or for other purposes. This approach for addressing problems of the prior art is described in greater detail in copending application Ser. No. 09,442,289 filed Nov. 19, 1999.

Even with the above arrangements, it is necessary to increase a fastening force in the crimped portion to compensate for a reduction in the number of the crimped portions. This is also essential to ensure an electrical conduction with the outer conductor.

In view of the above problems, an object of the present invention is to provide a terminal and a method for crimping which can secure an electrical conductor.

SUMMARY OF THE INVENTION

The subject invention is directed to a terminal, comprising a crimping portion to be fastened to an end of a shielded cable. The shielded cable has an insulating element between inner and outer conductors, and the outer conductor has an outer surface covered by a sheath. The end of the cable is processed to expose portions of the inner and outer conductors, and the exposed portion of the outer conductor may be folded back over the sheath.

The crimping portion of the terminal can be fastened to the outer conductor. More particularly, the crimping portion comprises one or more crimping pieces which are to be crimped to wind at least partly on or around the outer conductor, and preferably around portions of the outer conductor that are folded back over the sheath. One or more projections are provided in positions on the inner surface of the crimping portion bite into and to hold the outer conductor, and preferably the portions of the outer conductor that are folded back over the sheath.

According to a preferred embodiment, the crimping portion can be fastened both to the sheath and to the outer conductor, preferably the portions of the outer conductor that are folded back over the sheath. Accordingly, a higher mechanical strength is provided and the connection is less sensitive to mechanical forces (such as pulling) on the shielded cable.

Preferably, the crimping pieces are to be or can be crimped to at least partly wind on or around the outer conductor with the end of a first crimping piece substantially placed or placeable on the end of a second crimping piece. Accordingly, an "overlap crimping" is advantageously possible.

According to a further preferred embodiment, there is provided a terminal, comprising a crimping portion to be fastened to an end of a shielded cable. The shielded cable has an insulating element between inner and outer conductors, and the outer surface of the outer conductor is covered by a sheath. The sheath is stripped to expose the outer conductor and the exposed outer conductor is folded back over the sheath so that the crimping portion can be fastened both to the sheath and to the outer conductor. The crimping portion comprises a pair of crimping pieces which are crimped to wind around the portion of the outer conductor that is folded back over the sheath, with the end of one crimping piece placed on that of the other crimping piece. At least a pair of projections are provided in positions of the inner surface of the crimping portion to bite into and hold the folded back portion of the outer conductor.

Accordingly, crimping is applied to a portion where the outer conductor is folded back over the sheath so that the terminal can be simultaneously fastened to the outer conductor and to the sheath. Hence, the entire length of the terminal is allowed to be shorter. In this case, the projections provided at the crimping portion hold the shielded cable by biting into portions of the outer conductor that are folded back over the sheath. Thus, the terminal can be fastened to the shielded cable with a sufficient force. Further, the terminal can be stably fastened to the shielded cable since the projections are arranged to hold the shielded cable firmly.

Preferably, the at least two crimping pieces extend from the bottom surface of the crimping portion while being spaced apart wider from each other toward the leading ends thereof. Further preferably, at least one projection is provided in a specified position on a bottom surface of the crimping portion and at least one projection is provided in a position at the leading end of the crimping piece, preferably the second crimping piece placeable below the first crimping piece after crimping. Accordingly, the projections are arranged in positions such that the projections and the shielded cable are unlikely to interfere with each other when the shielded cable is inserted into the terminal for crimping. Hence the shielded cable can be inserted smoothly.

Preferably, the projection provided at the leading end of the second or other crimping piece that is placed below or radially inwardly after crimping is spaced from the leading edge of the other crimping piece by a distance such that this projection can be located substantially right above the projection at the bottom surface when the outer diameter of the outer conductor is a reference value of its range of variation.

The outer diameter of the outer conductor at the folded portion may vary. In such a case, the position of the projection located at the leading end of the crimping piece after crimping is circumferentially displaced. As a result, the biting forces of this projection and the one at the bottom surface may not be balanced along vertical or diametrical direction. However, according to the above embodiment, if the terminal is fastened to the folded portion whose outer diameter is a reference value (about a middle value between the maximum and minimum diameters) of a range of predictable variation, the projection on the crimping piece can be located substantially right above the one on the bottom surface. When the folded portion whose outer diameter is the maximum or minimum value of the predictable variation range is fastened, the projection on the crimping piece is displaced only circumferentially from the diametrically opposite position by a small angle, which does not hinder the fastening in either case.

Most preferably, each projection has such a wedge-shape that its front surface extends at an angle different from 0° or 180°, preferably substantially normal to an insertion direction of the cable and its height is lowered toward the back. Accordingly, since each projection is wedge-shaped, the shielded cable can be inserted smoothly without the projection getting caught by the shielded cable, especially by the position of the outer conductor that is folded back over the sheath. Therefore, the cable can be inserted with an improved efficiency.

According to the invention, there is further provided a method for crimping a terminal onto a shielded cable. The terminal comprises a crimping portion with diverging crimping pieces. At least one projection is formed on the crimping portion. The cable has an insulating element provided between inner and outer conductors. The outer surface of the outer conductor is covered by a sheath. The method comprises stripping the sheath to expose the outer conductor. The method then includes fastening the crimping portion of the terminal to the outer conductor by at least partly winding one or more crimping pieces of the crimping portion on or around the outer conductor, thereby biting the one or more projections on the crimping portion into the outer sheath.

According to a preferred embodiment, the outer conductor is folded back over the sheath, and the crimping portion is fastened to both the sheath and the outer conductor.

Preferably, in the fastening step, the crimping pieces are crimped to at least partly wind on or around the outer conductor with the end of a first crimping piece substantially placed on that of a second crimping piece.

These and other objects, features and advantages of the present invention will become more apparent upon a reading of the following detailed description and accompanying drawings.

DETAILED DESCRIPTION OF THE PREFERRED EMBODIMENTS

Figure 1:
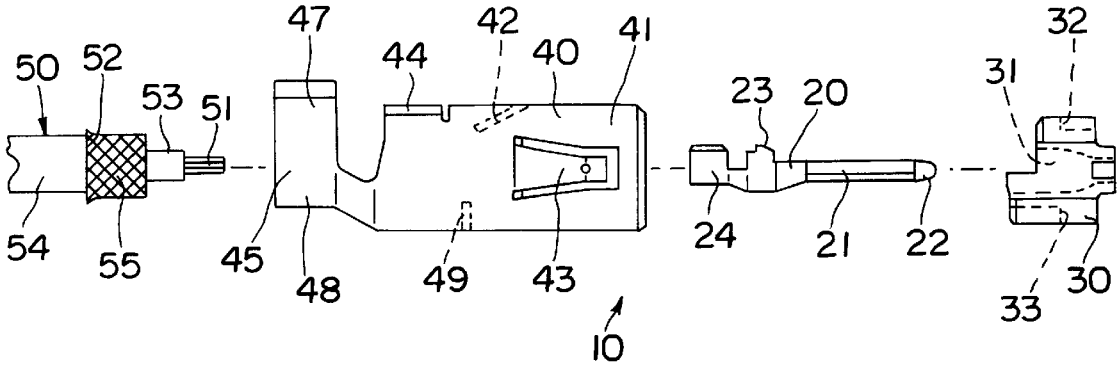
FIG. 1 is an exploded side view showing parts constructing a terminal according to a first embodiment.

A shielded connector according to a first embodiment of the invention is identified by the numeral 10 in FIG. 1. The connector 10 has an inner terminal 20 which is accommodated at least partly in a dielectric element 30, which in turn, is accommodated at least partly in an outer terminal 40. A shielded cable 50 is connected or connectable with the shielded connector 10. In the description below, a side (right side in FIG. 1) of the connector 10 to be connected with an unillustrated mating connector is referred to as a front side and an opening direction (an upward direction in FIG. 1) of an outer crimping portion 45 before being assembled is referred to as an upward direction.

The shielded cable 50 is constructed such that an insulating element 53 is provided between an inner conductor 51 formed e.g. by bundling a plurality of strands and an outer conductor 52 made e.g. of a braided wire. The outer surface of the outer conductor 52 is surrounded by a sheath 54 made of, e.g. vinyl (see FIG. 1). The inner conductor 51 is connected or connectable with the inner terminal 20, whereas the outer conductor 52 is connected or connectable with the outer terminal 40.

The inner terminal 20 is preferably a female terminal, as shown in FIG. 1, and is electrically conductive. A front part of the inner terminal 20 is a tab portion 21 that is engageable with an unillustrated female terminal. A tapered surface 22 is formed at the leading end of the tab portion 21. A rear part of the inner terminal 20 is formed to define a biting or engaging projection 23 for securing the inner terminal 20 by biting into or engaging the upper wall of an accommodating hole 31 when the inner terminal is inserted into the dielectric element 30. An inner crimping portion 24 is provided behind the biting projection 23 and is fastened to the inner conductor 51.

The dielectric element 30 is made of an insulating material such as resin, and is electrically insulated from the inner and outer terminals 20, 40. The accommodating hole 31 is defined inside the dielectric element 30 for fixing the inner terminal 20 accommodated therein. The upper wall of the dielectric element 30 is formed with a locking recess 32 and the bottom wall thereof is formed with a contact portion 33 (see FIG. 1). The locking recess 32 and the contact portion 33 engage portions of the outer terminal 40 for locking the dielectric element 30 in the outer terminal 40.

The outer terminal 40 is formed e.g. by bending an electrically conductive plate. A front part of the outer terminal 40 defines an accommodating portion 41 preferably in the shape of a rectangular tube. A substantially elastically deformable locking portion 42 and a contact piece 49 are provided on the upper and bottom walls of the accommodating portion 41, respectively, for locking the dielectric element 30 in a specified position in the accommodating portion 41. Contact pieces are provided on the left and right side walls elastically contacting and locking an unillustrated shielded connector. Stabilizers 44 project outwardly along the transverse direction of the outer terminal 40 at a location behind the accommodating portion 41. The stabilizers 44 are provided to substantially position the shielded connector 10 while it is inserted into an unillustrated connector housing and substantially to stably fix the shielded connector 10 in the connector housing after insertion.

Figure 7:
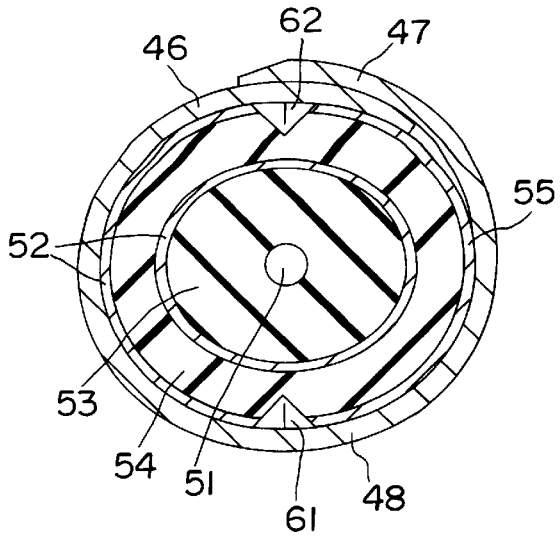
FIG. 7 is a horizontal section of an outer conductor crimping portion and the folded portion after crimping.
Figure 8A:
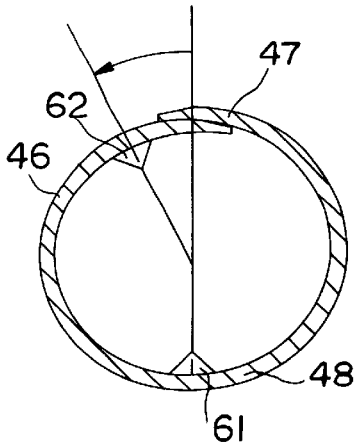
FIGS. 8(*a*) and 8(*b*) are horizontal sections of the outer conductor crimping portions when shielded cables of different diameters are fastened.
Figure 8B:
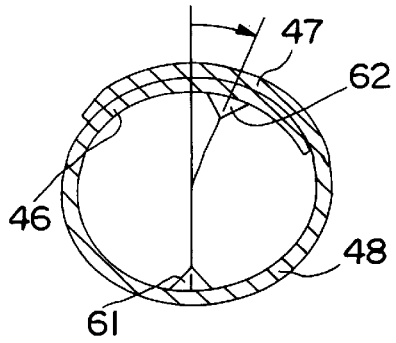

An outer crimping portion 45 to be fastened to a folded portion 55 of the shielded cable 50. The outer crimping portion 45 is provided with a pair of preferably substantially strip-shaped crimping pieces 46, 47 that extend from a bottom portion 48. The crimping pieces 46, 47 are spaced gradually wider and slanted or thinned surfaces preferably are formed at the leading ends thereof. The crimping pieces 46, 47 preferably have a length sufficient to at least partially surround shielded cables of various diameters, preferably to surround them while partly overlapping on each other (FIGS. 7 and 8).

Figure 2:
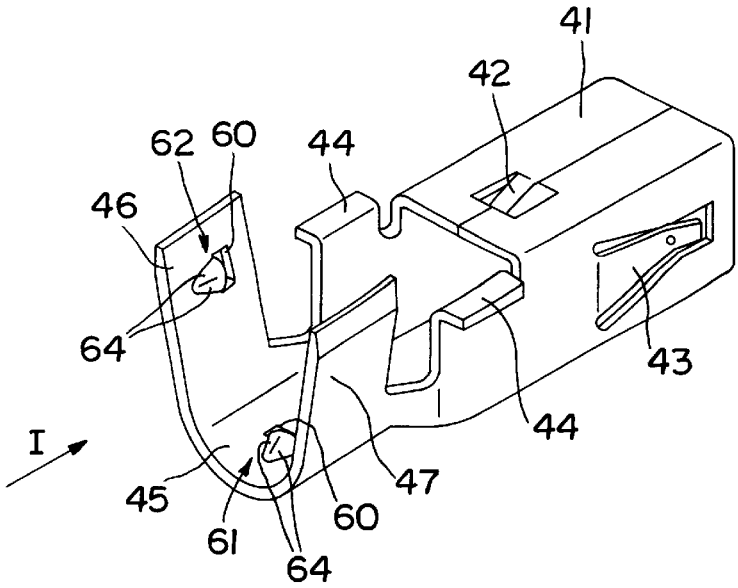
FIG. 2 is a perspective view of an outer terminal of the terminal.

Slits 60 are formed in the outer crimping portion 45, in specified positions of the crimping portions 46, 47 and/or the bottom portion 48. Portions of the crimping portions 46, 47 and/or the bottom portion 48 behind the slits 60 are embossed inwardly to form projections 61, 62 that preferably have their leading ends located substantially at the slits 60. The projections 61, 62 are substantially in the form of a triangular prism (see FIG. 2) or other protruding polygonal shape.

Figure 3:
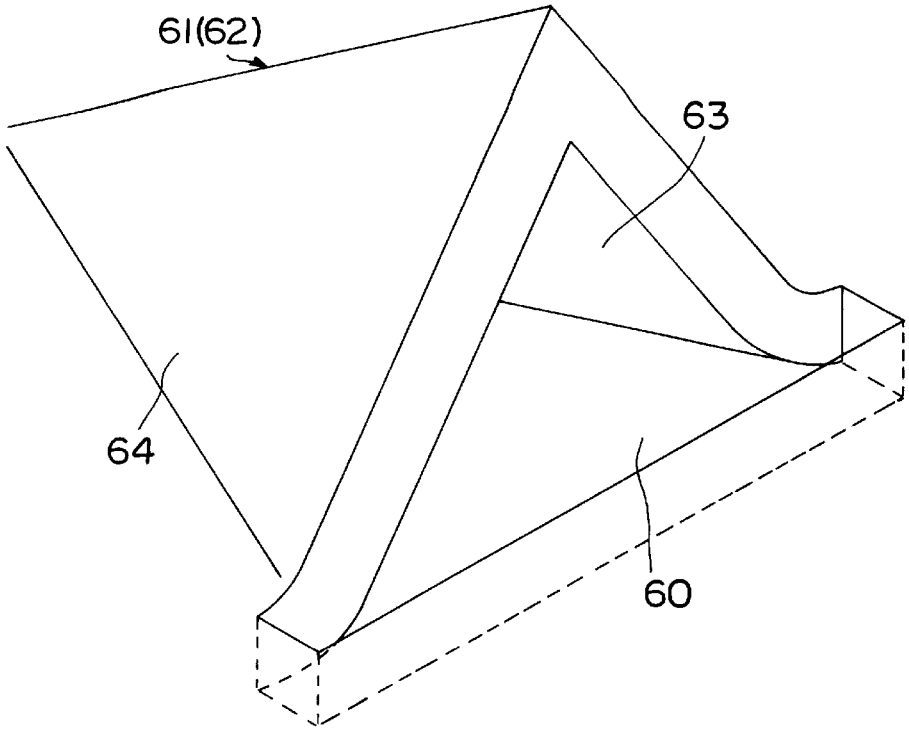
FIG. 3 is an enlarged view of a projection.

As shown in FIG. 3, the front ends of the projections 61, 62 serve as raised portions 63 which are substantially open forwardly. Left and right side surfaces 64 of the projections 61, 62 face backwardly and are closed to define wedge-shapes that are lowered moderately toward the back. In this embodiment, the bottom projection 61 and the upper projection 62 are formed in the bottom portion 48 and at the end of the crimping piece 46.

The shielded connector 10 is assembled by first stripping the sheath 54 at the end of the shielded cable 50 to expose the outer conductor 52. Exposed portions of the outer conductor 52 preferably are folded back over the sheath 54, thereby forming a folded portion 55 (see FIG. 1). Subsequently, the insulating element 53 of the shielded cable 50 is stripped to expose the inner conductor 51. Inner crimping portion 24 of the inner terminal 20 then is fastened to the inner conductor 51.

Next, the dielectric element 30 is inserted into the accommodating portion 41 of the outer terminal 40 from front. Then, the contact portion 33 comes into contact with the contact piece 49 and the locking portion 42 slips substantially into the locking recess 32, thereby substantially locking the dielectric element 30 in a specified position in the accommodating portion 41. The inner terminal 20 that has been connected with the inner conductor 51 then is inserted into the accommodating hole 31 of the dielectric element 30. As a result, the biting projection 23 bites or presses into or engages the upper wall of the accommodating hole 31 to stably fix the inner terminal 20 (see FIG. 6).

Figure 4:
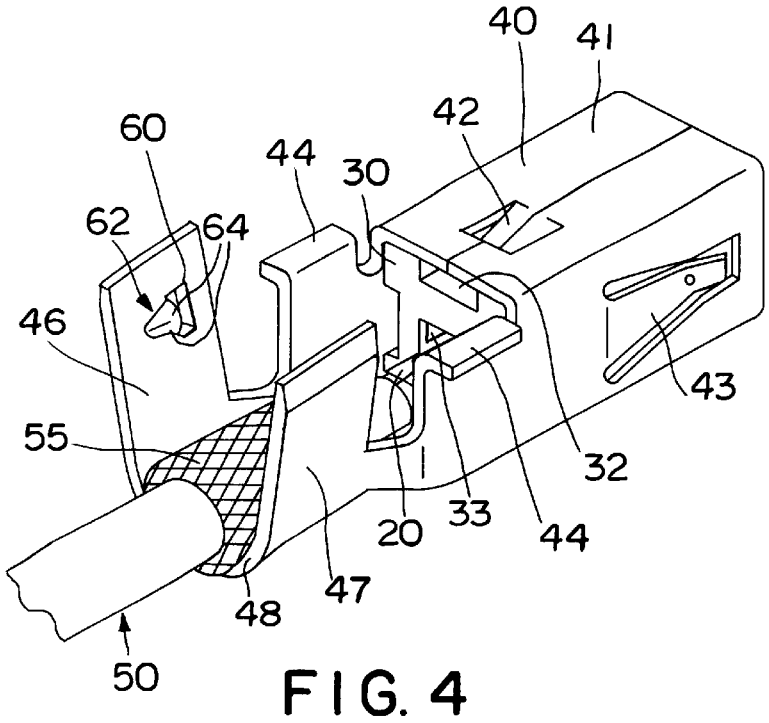
FIG. 4 is a perspective view of the terminal before being fastened to a folded portion.

The folded portion 55 of the cable 50 then is placed on the bottom portion 48 of the outer terminal 40, such that the bottom projection 61 formed at the bottom portion 48 bites into the folded portion 55. As noted above, the crimping pieces 46, 47 are spaced most narrowly at their bases near the bottom portion 48 as shown in FIG. 4. Hence, the folded portion 55 is held between the bases of the crimping pieces 46, 47 and is hooked by the bottom projection 61. Consequently the cable 50 will not be displaced in widthwise direction.

The shielded connector 10, in the state of FIG. 4, is placed in an unillustrated crimper. The crimping piece 46 is brought at least partly into substantially close contact with the outer surface of the outer conductor 52 or its the folded portion 55 and the bottom and upper projections 61, 62 are caused to bite sufficiently into or press against or engage the folded portion 55. The crimping piece 47 is brought at least partly into substantially close contact with the outer surface of the outer conductor 52 or its the folded portion 55. At this time, crimping preferably is performed such that the end of the crimping piece 47 is placed on that of the crimping piece 46 (see FIG. 7).

Figure 5:
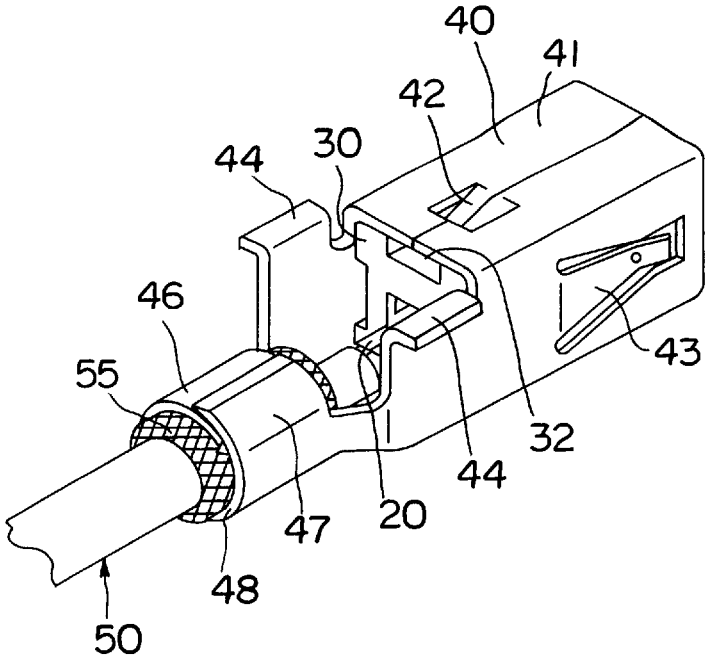
FIG. 5 is a perspective view of the terminal after crimping.

FIG. 5 shows the shielded connector 10 after crimping. Here, the outer crimping portion 45 is crimped to substantially squeeze the sheath 54 and be in close contact with the folded portion 55. Further, the projections 61, 62 tightly hold the folded portion 55 while strongly biting into or engaging the sheath 54 of the folded portion 55 (see FIGS. 6 and 7). As a result, electrical connection is secured since the folded portion 55 and the outer crimping portion 45 are connected electrically and a sufficient fastening force is obtained.

According to the terminal of this embodiment, the projections 61, 62 secure an electrical connection with the outer conductor 52 by biting into or pressing against or engaging the outer conductor 52 preferably of the folded portion 55 of the shielded cable 50, and securely hold the shielded cable 50 by further biting into or engaging the sheath 54. This increases a fastening force and stabilizes the connection. The crimping pieces 46, 47 may come to have a weaker fastening force due to the elastic restoration after crimping and vibrations produced while the connector 10 is being used. However the projections 61, 62 bite into the folded portion 55 and effectively stabilize the connection of the shielded connector 10 with the shielded cable 50 after crimping. Therefore a considerably improved fastening force of the shielded connector 10 is obtained, thereby securing the electrical connection.

Figure 6:
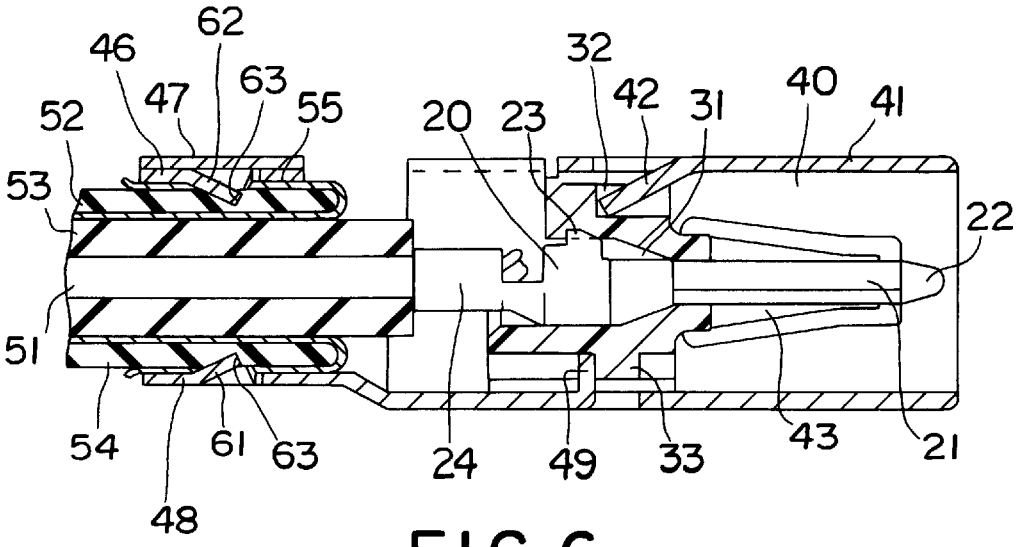
FIG. 6 is a vertical section of the terminal after crimping.

Further, with the shape of the projections 61, 62 according to this embodiment, the raised portions 63 bite more into the sheath 54 as shown in FIG. 6 if a stretching load acts on the shielded cable 50 in backward direction after crimping. This prevents the shielded cable 50 from coming out and enables the connection to be maintained.

The fastening force can be increased further because the upper projection 62 is on the lower crimping piece and is pressed doubly by the overlapped crimping of both crimping pieces.

The upper projection 62 is provided at the leading end of the crimping piece 46 and the crimping piece 46 is so formed as to be spaced substantially wider apart from the crimping piece 47 toward its leading end before crimping. This orientation prevents the shielded cable 50 from being caught by the upper projection 62, and hence crimping can be performed smoothly Particularly, the folded portion 55 is likely to get caught by an other member because its outer surface is formed by the braided wire of the outer conductor 52. However, since the projections 61, 62 of the shielded connector 10 of this embodiment do not have any surface extending in such a direction as to face the shielded cable 50 being inserted in an insertion direction 1, they do not catch the folded portion 55 during the insertion of the shielded cable 50. This enables the shielded cable 50 to be inserted smoothly, therefore improving operational efficiency.

As already described, this embodiment is designed to increase the fastening force by providing the projections 61, 62 in two vertically displaced positions, and causing them to bite into the shielded cable 50 from above and below. However, the outer diameter of the folded portion 55 formed by folding back the outer conductor 52 may vary. This is thought to cause a problem in some situations. Accordingly in this embodiment, the position of the upper projection 62 is set to ensure satisfactory fastening in any case within a range between the minimum and maximum values of predictable variation (see FIG. 8).

Specifically, the position of the upper projection 62 is set in a position spaced from the leading edge of the crimping piece 62 by a specified distance in this embodiment. A middle value between the maximum and minimum diameters of the predictable variation is set as a reference value, and the position of the upper projection 62 is set such that the upper projection 62 is located right above the bottom projection 61 when the folded portion 55 having an outer diameter of the reference value is fastened. Thus, depending upon whether the outer diameter of the folded portion 55 is larger or smaller than the reference value, the upper projection 62 is displaced circumferentially to the right or clockwise or to the left or anti-clockwise from the position right above the bottom projection 61. In other words, the upper projection 62 is displaced to the left or anticlockwise as shown in FIG. 8(*a*) if the outer diameter of the folded portion 55 is larger than the reference value while displaced to the right or clockwise as shown in FIG. 8(*b*) if it is smaller than the reference value. The displacement from the reference value is small in any case and, therefore, the folded portion can be fastened satisfactorily over the entire range of the variation.

Figure 9:
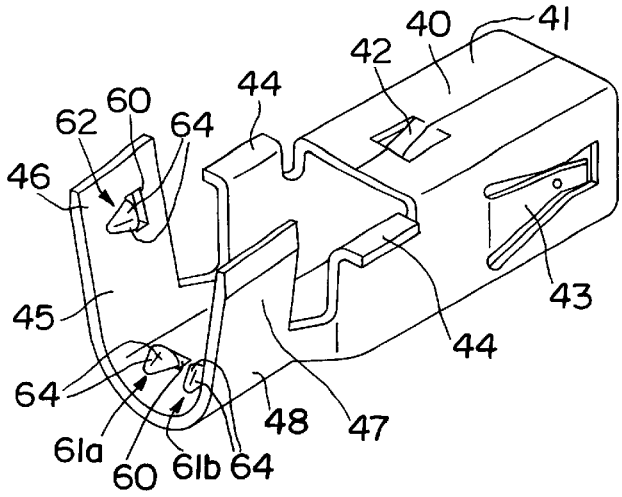
FIG. 9 is a perspective view of an outer terminal of a terminal according to a second embodiment.

FIG. 9 shows a second embodiment of the invention. The second embodiment differs from the first embodiment in that two bottom projections 61*a*, 62*b* are provided at the bottom portion 48 of the outer crimping terminal 45. Since the other construction is same or similar as the first embodiment, no repetitive description is given thereon by identifying it by the same reference numerals.

By providing the two projections at the bottom of the terminal according to this embodiment, the shielded cable 50 can be held more stably and firmly since the three projections bite into the folded portion after crimping.

Further, since the two projections provided at the bottom bite into or engage the outer conductor 52 when the shielded cable 50 is placed on the outer crimping portion 45, the crimping operation can be performed more easily with the shielded cable 50 more stably held, thereby improving an operation efficiency.

The present invention is not limited to the foregoing embodiments. For example, embodiments as described below are also embraced by the technical scope of the present invention as defined in the claims. Besides the following embodiments, a variety of changes can be made without departing from the scope and spirit of the present invention as defined in the claims.

Although one or two projections are provided at the bottom surface and one projection is provided at the side surface(s) in the foregoing embodiments, one or a plurality of projections may be provided at each or either of the bottom surface and the side surface(s) such as in a case where two projections are provided both at the bottom surface and at the side surface.

Figure 10:
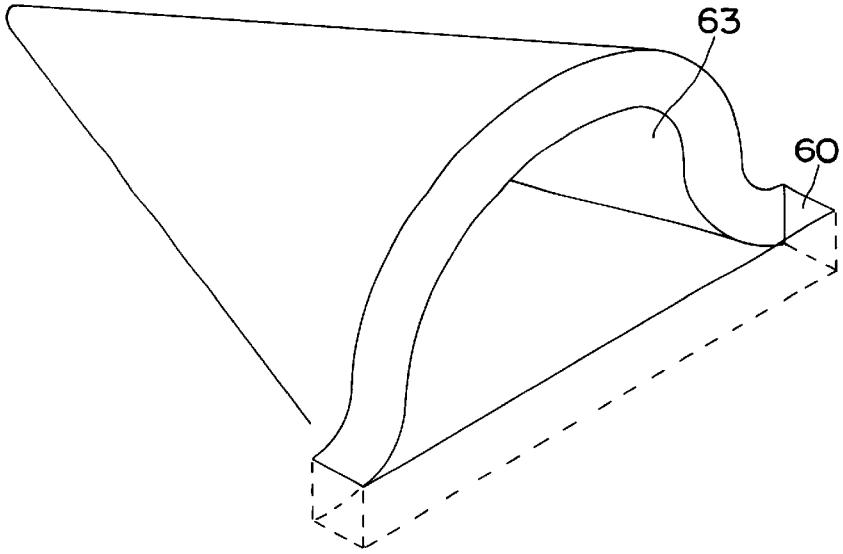
FIG. 10 is an enlarged view of a projection of a terminal according to an other embodiment (2).
Figure 11:
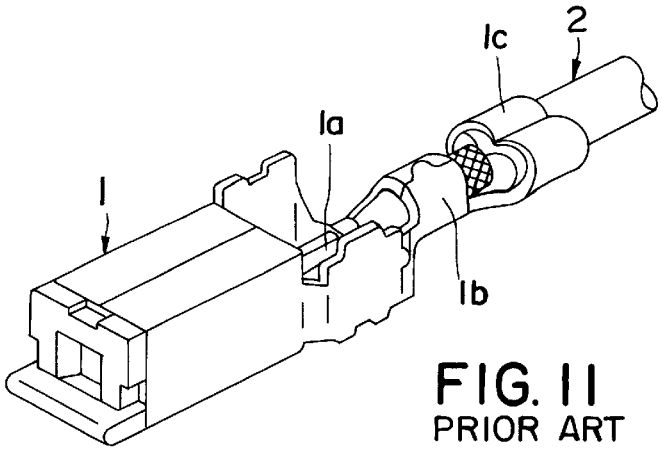
FIG. 11 PRIOR ART
FIG. 11 is a perspective view of a prior art terminal.

Although the projections 61, 62 are substantially in the form of a triangular prism and the side surfaces 64 there are planar in the foregoing embodiments, the side surfaces 64 may be curved surfaces. Alternatively, the projections 61, 62 may have a continuously or partly curved surface as shown in FIG. 10.

What is claimed is:

1. A terminal and cable assembly, comprising a shielded cable between inner and outer conductors, the outer conductor having an outer surface covered by a sheath, a portion of the outer conductor being exposed and folded back over the sheath to define a folded portion, a terminal having a crimping portion comprising at least one crimping piece crimped and wound at least partly around the folded portion of the outer conductor, at least one projection being provided on an inner surface of the crimping piece, said projection comprising a slit aligned transverse to the cable and an embossment on a side of the slit away from the end of the cable, the embossment being dimensioned for biting through the folded portion and into portions of the sheath under the folded portion for mounting the terminal on the cable and holding the folded portion over the sheath.

2. A terminal according to claim 1, wherein the at least one crimping piece comprises first and second crimping pieces crimped to wind at least partly around the folded portion of the outer conductor with an end of the first crimping piece place on an end of the second crimping piece.

3. A terminal for a shielded cable, comprising a crimping portion to be fastened to an end of a shielded cable, the shielded cable having an insulating element between inner and outer conductors, the outer conductor having an outer surface covered by a sheath, a portion of the outer conductor being exposed and folded over the sheath to define a folded portion, the crimping portion of the terminal comprising a bottom surface and first and second crimping pieces extending from the bottom surface, the first and second crimping pieces each having an end remote from the bottom portion of the crimping portion, the first and second crimping pieces being dimensioned to be crimped toward one another and to wind at least partly around the folded portion of the outer conductor, with the end of the first crimping piece placed on the end of the second crimping piece, at least one projection being provided in a specified position on the bottom surface of the crimping portion and at least one projection being provided in a position in proximity to the end of the second crimping piece placeable below the first crimping piece after crimping.

4. A terminal according to claim 3, wherein the projection provided at the leading end of the second crimping piece is provided in a position spaced apart from the leading edge of the first crimping piece by a specified distance such that the projection on the second crimping piece can be located substantially right above the projection at the bottom surface when the outer diameter of the outer conductor is a reference value of its range of variation.

5. A terminal according to claim 3, wherein each projection has a wedge-shape with a front surface extending at an angle different from 0° or 180° to an insertion direction of the cable.

6. A method for crimping a terminal on a shielded cable, the method comprising the following steps:

providing a shielded cable having an insulating element between inner and outer conductors and an insulating sheath covering the outer conductor;

stripping a portion of the sheath to expose a portion of the outer conductor;

folding the exposed portion of the outer conductor over the sheath;

providing a terminal having a crimping portion with at least one elongate crimping piece, the crimping portion having at least one projection formed thereon, the projection comprising a slit extending substantially parallel to the elongate crimping piece and an embossment formed on one side of the slit;

fastening the crimping portion to the portion of the outer conductor by at least partly winding the crimping piece of the crimping portion around the folded portion of the outer conductor thereby biting the projection provided on the crimping portion through the folded portion of the outer conductor into the outer sheath beneath the folded portion of the outer conductor.

7. A method according to claim 6, wherein the step of providing a terminal with a crimping portion having at least one crimping piece comprises providing a terminal having a crimping portion with first and second crimping pieces, and wherein in the fastening step, the crimping pieces are crimped to wind at least partly around the outer conductor with an end of the first crimping piece being placed on the end of the second crimping piece.

* * * * *